US006820549B2

(12) United States Patent
Iyokawa et al.

(10) Patent No.: US 6,820,549 B2
(45) Date of Patent: Nov. 23, 2004

(54) ROTARY PRESS

(75) Inventors: Kazuya Iyokawa, Chiba (JP); Kazushi Noguchi, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/645,433

(22) Filed: Aug. 18, 2003

(65) Prior Publication Data

US 2004/0074407 A1 Apr. 22, 2004

(30) Foreign Application Priority Data

Aug. 20, 2002 (JP) ..... 2002/239607

(51) Int. Cl.[7] ..... B41F 13/54
(52) U.S. Cl. ..... 101/228; 101/DIG. 42
(58) Field of Search ..... 101/178, 179, 101/180, 181, 216–219, 227, 228, 231, 484, 485, DIG. 42, 92, 225; 226/34, 35, 38, 193, 195

(56) References Cited

U.S. PATENT DOCUMENTS 3,667,664 A 6/1972 Schroeder
4,201,132 A * 5/1980 Zimmer et al. ..... 101/118
4,657,164 A * 4/1987 Felix ..... 226/42
4,722,275 A * 2/1988 Taguchi et al. ..... 101/228
5,443,008 A * 8/1995 Pavliny et al. ..... 101/484
5,996,492 A * 12/1999 Jurkewitz et al. ..... 101/228
6,058,844 A * 5/2000 Niemiec ..... 101/488
6,295,925 B1 * 10/2001 Sarni et al. ..... 101/228

FOREIGN PATENT DOCUMENTS

EP 1153744 11/2001
JP 07-041221 A 2/1995
JP 11165400 6/1999
JP 2001-315296 A 11/2001

* cited by examiner

*Primary Examiner*—Ren Yan
(74) *Attorney, Agent, or Firm*—Blakely Sokoloff Taylor & Zafman

(57) ABSTRACT

A rotary press includes a printing unit, folding machine, dancer roller, motor, tension detection unit, and control unit. The printing unit prints on a web supplied from a winding roll. The folding machine folds the printed web supplied from the printing unit. The dancer roller retreats from and advances to a web traveling path between the printing unit and the folding machine, during printing and plate mounting, respectively, to come into contact with the web. The motor selectively, rotatably drives the winding roll in a reel-out direction and a winding direction. The tension detection unit detects a tension of the web between the winding roll and the printing unit. The control unit controls the motor on the basis of a detection result of the tension detection unit during plate mounting.

9 Claims, 7 Drawing Sheets

ROTARY PRESS

BACKGROUND OF THE INVENTION

The present invention relates to a rotary press for printing on a web and, more particularly, to a rotary press in which a slack or excessive tension of the web which occurs between a winding roll and printing unit during plate replacing can be removed.

A rotary press of this type is disclosed in Japanese Patent Laid-Open No. 2001-315296. In the rotary press disclosed in this reference, a web press is provided in a web traveling path between a feeder and a printing unit, and a dancer roller serving as a wrap-up preventive member is provided downstream of the web press.

In this arrangement, a slack or excessive tension of the web which occurs in the web traveling path between the feeder and printing unit during plate replacing is removed by the dancer roller. After the plate replacing, when the web is to be fed, the web is pressed by the web press, and feeding from the feed roll is discontinued, so that the slack of the web is removed smoothly.

In the conventional rotary press described above, as the slack or unusual slack of the web is removed by the dancer roller, when web threading is to be performed, it is cumbersome to thread the web through the dancer roller or a guide roller provided before or after the dancer roller, thus interfering with reduction of the work time. Since the dancer roller which is used only for plate replacing must be provided, the entire length of the printing press increases by the dancer roller. Since the web press is needed, the entire length of the printing press increases by the web press.

SUMMARY OF THE INVENTION

It is an object of the present invention to provide a rotary press that can perform web threading operation easily.

It is another object of the present invention to provide a rotary press in which the entire length of the machine is shortened.

In order to achieve the above objects, according to the present invention, there is provided a rotary press comprising a printing unit for printing on a web supplied from a winding roll, a folding machine for folding the printed web supplied from the printing unit, a wrap-up preventive member retreating from and advancing to a web traveling path between the printing unit and the folding machine, during printing and plate mounting, respectively, to come into contact with the web, driving means for selectively, rotatably driving the winding roll in a reel-out direction and a winding direction, tension detecting means for detecting a tension of the web between the winding roll and the printing unit, and control means for controlling the driving means on the basis of a detection result of the tension detecting means during plate mounting.

DESCRIPTION OF THE PREFERRED EMBODIMENT

Figure 1:
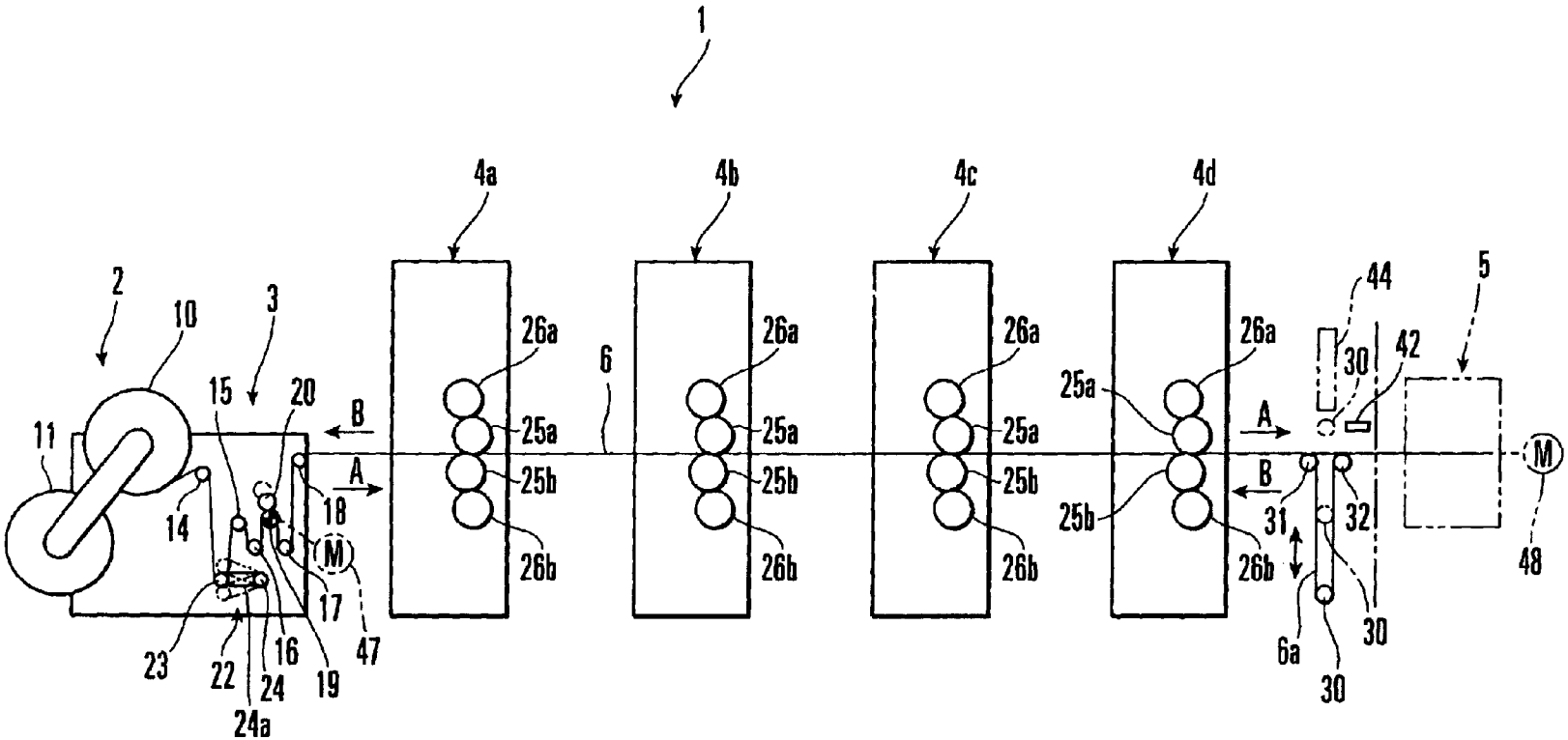
FIG. 1 is a view schematically showing the entire arrangement of a rotary press according to an embodiment of the present invention.

A rotary press according to one embodiment of the present invention will be described with reference to FIGS. 1 to 3B. As shown in FIG. 1, a rotary press 1 of this embodiment is constituted by a feeder 2 for feeding a web 6, an in-feed unit 3 for controlling the tension of the web 6 fed from the feeder 2, printing units 4*a* to 4*d* of different colors for printing on the web 6 fed from the in-feed unit 3, and a folding machine 5 for drying and cooling the web 6 printed by the printing units 4*a* to 4*d* and folding it with a predetermined format. The feeder 2 has a diver 12. These units are sequentially arranged in the web convey direction.

Figure 2:
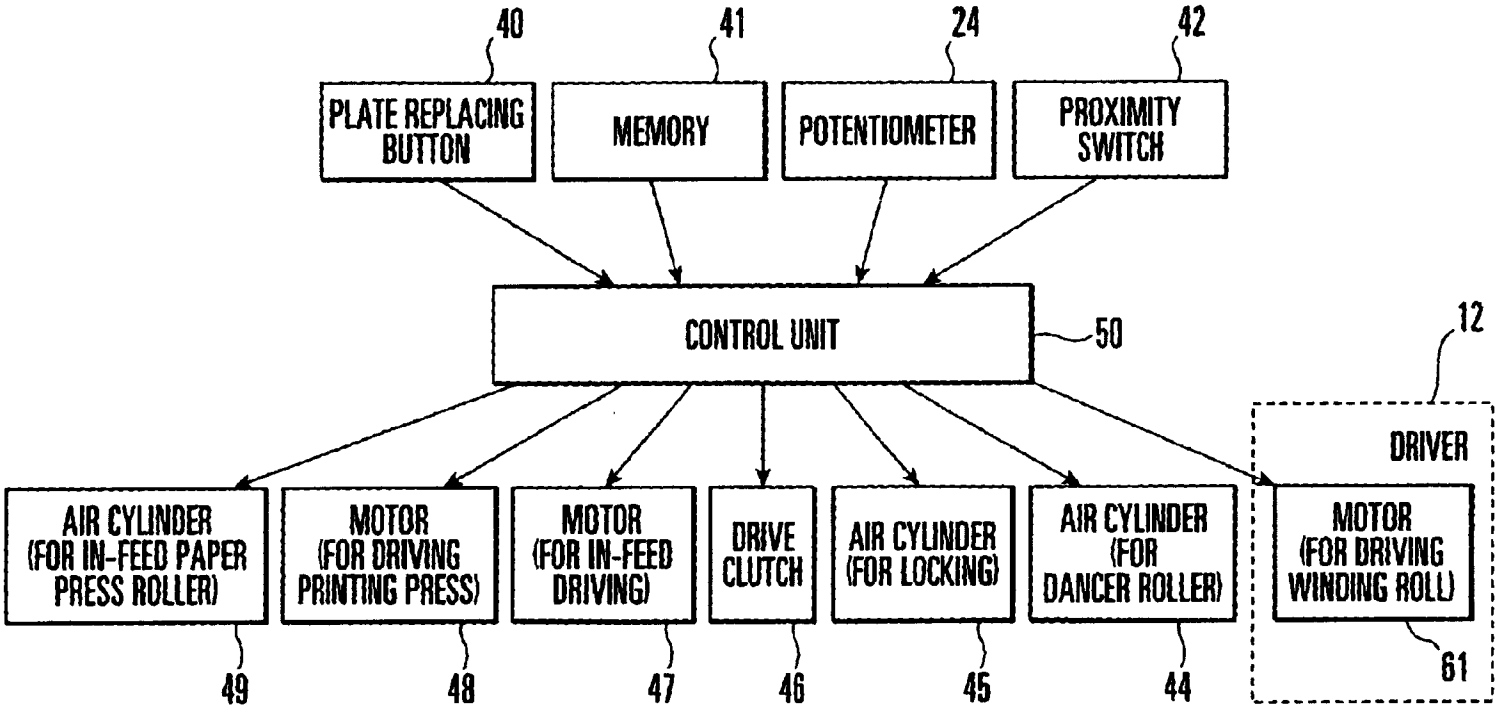
FIG. 2 is a block diagram showing the electrical arrangement of the rotary press shown in FIG. 1.

As shown in FIG. 2, the rotary press 1 is electrically constituted by a potentiometer 24 for measuring the tension of the web 6 at the in-feed unit 3, a plate replacing button 40 for instructing start of plate replacing, a memory 41 for storing the preset tension value of the web 6 at the in-feed unit 3 which is set by a setting unit (not shown), a proximity switch 42 for detecting that a dancer roller 30 is near, an air cylinder 44 for moving the dancer roller 30 in the vertical direction, an air cylinder 45 for locking the dancer roller 30 at an upper retreat position, a drive clutch 46 for connecting and disconnecting the driving mechanisms (not shown) of the printing units 4*a* to 4*d* and the driving mechanism (not shown) of the folding machine 5 to and from each other, a motor 47 for driving an in-feed driving roller 19, a motor 48 for driving the rotary press 1, an air cylinder 49 for driving an in-feed paper press roller 20, the diver 12 having a motor 61 for driving a winding roll 10, and a control unit 50 for controlling these units.

The feeder 2 has the winding roll 10 on which the web 6 is wound to form a roll, and a spare winding roll 11. The winding roll 10 is selectively driven by the motor 61 in a direction to reel out the web 6 (a direction of an arrow A) and a direction to wind the web 6 (a direction indicated by an arrow B). The driving system of the winding roll 10 is connected to a brake 53 (FIG. 3B), so that the winding roll 10 can be braked while feeding the paper.

Figure 3A:
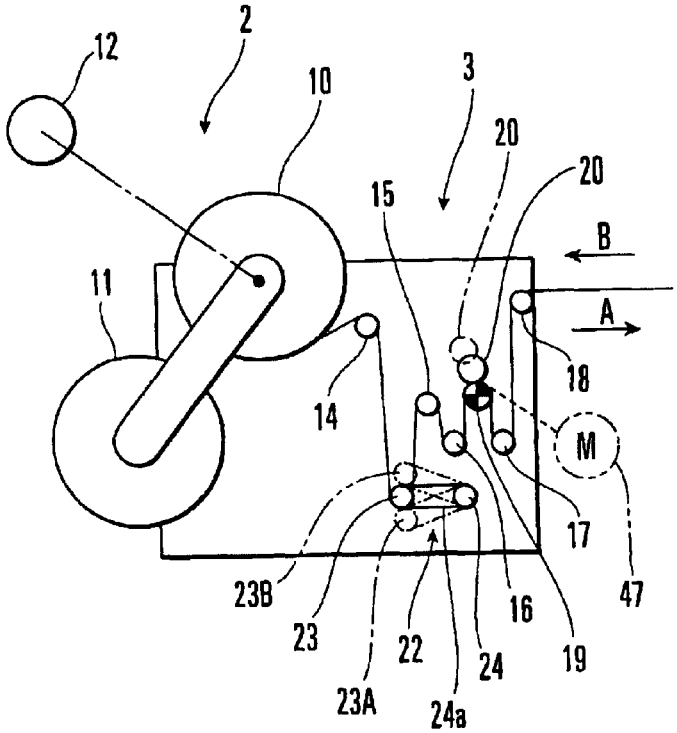
FIG. 3A is an enlarged view of the feeder and in-feed unit shown in FIG. 1.

As shown in FIG. 3A, the in-feed unit 3 has a plurality of guide rollers 14, 15, 16, 17, and 18 for guiding the web 6 fed from the winding roll 10 to the printing units 4*a* to 4*d*. The in-feed driving roller 19 provided between the guide rollers 16 and 17 rotatably drives and brakes the web 6 with the motor 47. The in-feed paper press roller 20 is driven by the air cylinder 49 to be able to come close to and separate from the in-feed driving roller 19.

A tension detection unit 22 is constituted by a tension detection roller 23 touching the web 6 under between the guide rollers 14 and 15, a lever 24*a* for supporting the tension detection roller 23 at its swing end, and the potentiometer 24 fixed to the proximal end of the lever 24*a* to rotate by the vertical motion of the tension detection roller 23 through the lever 24*a*. The potentiometer 24 outputs an output corresponding to the pivot amount of the lever 24*a* to the control unit 50. The lever 24*a* and potentiometer 24 make up a position detecting means for detecting the position of the tension detection roller 23.

The printing units 4*a* to 4*d* of four different colors are subordinately connected. Each of the printing units 4*a* to 4*d* has a pair of blanket cylinders 25*a* and 25*b* that clamp the traveling web 6, a pair of plate cylinders 26*a* and 26*b* in contact opposite to the blanket cylinders 25*a* and 25*b*, an inking device (not shown) and dampening device (not shown) for supplying water and ink, respectively, to the plate cylinders 26*a* and 26*b*, and a roller group interposed between the inking device and the plate cylinders 26*a* and 26*b*.

Guide rollers 31 and 32 sequentially arranged in the web convey direction are provided between the printing unit 4*d* and the folding machine 5, and the dancer roller 30 as the wrap-up preventive member is arranged between the guide rollers 31 and 32. The dancer roller 30 retreats to the traveling path of the web 6 between the printing unit 4*d* and folding machine 5 during printing, and advances to the traveling path during plate mounting to prevent wrap-up of the web 6 onto the blanket cylinders 25*a* and 25*b*.

The dancer roller 30 is supported to be vertically movable by the air cylinder 44. When the air cylinder 44 is not actuated, the dancer roller 30 is always biased downward with a predetermined pressure. After the plate mounting, the dancer roller 30 moves upward by the air cylinder 44, and is locked by the air cylinder 45 at the retreat position (indicated by an alternate long and two short dashed line in FIG. 1) during printing which is detected by the proximity switch 42.

In plate replacing, the control unit 50 compares the tension of the web 6 at the in-feed unit 3 which is detected by the potentiometer 24 and a preset tension value stored in the memory 41, and controls a motor 61 when the detected tension and the preset tension value are different. More specifically, when the tension of the web 6 is smaller than the preset tension value, the motor 61 is controlled to rotate in a direction to wind the web 6. When the tension of the web 6 is larger than the preset tension value, the motor 61 is controlled to rotate in a direction to reel out the web 6.

Figure 3B:
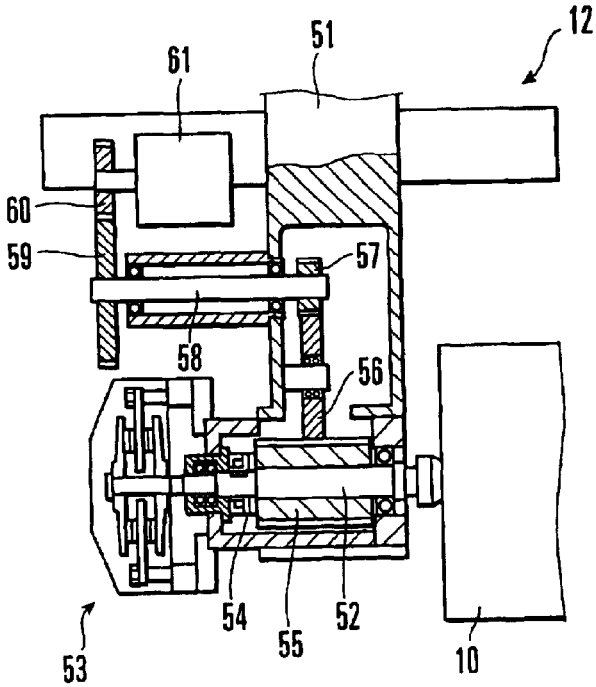
FIG. 3B is a view showing the driving unit of the feeder shown in FIG. 3A.

As shown in FIG. 3B, the diver 12 has a rotary shaft 52 rotatably supported by a frame 51 to rotate integrally with the winding roll 10, the brake 53 attached to the rotary shaft 52, the motor 61 for rotatably driving the rotary shaft 52, and a clutch 54 for connecting and disconnecting the driving system between the motor 61 and rotary shaft 52. A driving gear 55 is loosely fitted on the rotary shaft 52, and rotates integrally with the rotary shaft 52 through the clutch 54. A first intermediate gear 57 meshes with a transmission gear 56 meshing with the driving gear 55. The first intermediate gear 57 is axially mounted on one end of an intermediate shaft 58. A second intermediate gear 59 is axially mounted on the other end of the intermediate shaft 58. An output gear 60 of the motor 61 meshes with the second intermediate gear 59.

In this arrangement, during the printing operation of the printing units 4*a* to 4*d*, the clutch 54 is disconnected, and a predetermined braking force is applied to the rotary shaft 52 by the brake 53, so that a predetermined tension is always applied to the web 6. In plate mounting, the rotary shaft 52 and driving gear 55 are connected to each other through the clutch 54 and rotate integrally with each other. Thus, the winding roll 10 can be rotated by the motor 61 in a direction to reel out or wind the web 6.

Plate mounting operation in the rotary press having the above arrangement will be described with reference to FIGS. 4A to 4D.

Figure 4A:
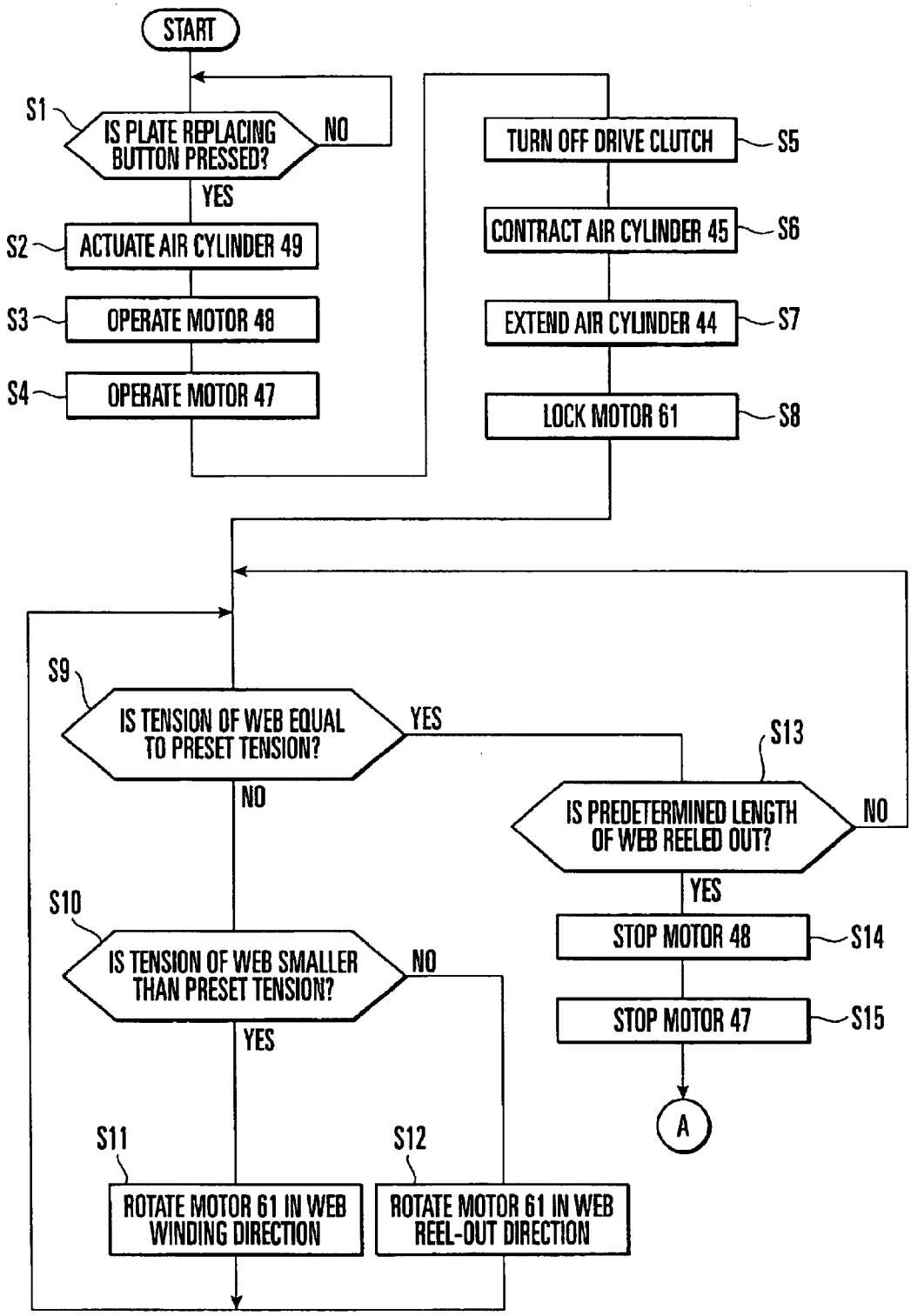
FIG. 4A is a flow chart showing the plate mounting operation of the rotary press shown in FIG. 1.

As shown in FIG. 4A, whether the plate replacing button 40 is pressed or not is checked (step S1). If YES, the air cylinder 49 is actuated (step S2), and the in-feed paper press roller 20 comes into contact opposite to the in-feed driving roller 19 with a predetermined nip pressure. Subsequently, when the motor 48 is operated (step S3), the plate cylinders 26*a* and 26*b* of the printing units 4*a* to 4*d* rotate in the forward direction, to feed the web 6 in the direction indicated by the arrow A in FIG. 1. In this case, forward direction refers rotation of the plate cylinders 26*a* clockwise in FIG. 1 and rotation of the plate cylinders 26*b* counter-clockwise in FIG. 1.

Simultaneously, the motor 47 is operated (step S4) to drive the in-feed driving roller 19. Then, the drive clutch 46 is turned off (step S5) to disconnect the driving system of the folding machine 5 and the driving systems of the printing units 4*a* to 4*d* from each other. As the plate cylinders 26*a* and 26*b* rotate in the forward direction, the web 6 between the printing unit 4 and folding machine 5 slacks consequently, to form a slack 6*a*.

Subsequently, the rod of the air cylinder 45 contracts (step S6), and the dancer roller 30 locked at the retreat position indicated by the alternate long and two short dashed line in FIG. 1 is unlocked. The rod of the air cylinder 44 extends (step S7), and the dancer roller 30 moves downward, so that the dancer roller 30 abuts against the slack 6*a* of the web 6. Hence, the slack 6*a* is pushed downward by the dancer roller 30. The slack 6*a* of the web 6 is hence stretched taught downward by the dancer roller 30, as indicated by a solid line in FIG. 1. Then, the motor 61 is locked so that it will not rotate (step S8).

Whether the tension of the web 6 at the in-feed unit 3 which is detected by the potentiometer 24 is equal to the preset tension value of the memory 41 or not is checked (step S9). If the two values are not equal, which one of the tension of the web 6 and the preset tension value is large is checked (step S10). The rotational direction of the motor 61 is controlled on the basis of this checking result (steps S11 and S12).

More specifically, in step S10, as shown in FIG. 3A, if the tension detection roller 23 has moved downward from the position indicated by the solid line to a position 23A indicated by the alternate long and short dashed line (if the tension of the web 6 is smaller than the preset tension value), the control unit 50 controls the motor 61 to rotate in the direction to wind the web 6 (step S11). Accordingly, even if the web 6 slacks at the in-feed unit 3, the slack is removed and the web 6 is restored to the taut state.

In step S10, as shown in FIG. 3A, if the tension detection roller 23 has moved upward from the position indicated by the solid line to a position 23B indicated by the alternate long and two short dashed line (if the tension of the web 6 is larger than the preset tension value), the control unit 50 controls the motor 61 to rotate in the direction to reel out the web 6 (step S12). Accordingly, even if an excessive tension occurs in the web 6 at the in-feed unit 3, the excessive tension is corrected and the web 6 is restored to the state wherein it is stretched taut with a normal tension, so that tearing of the web 6 is prevented.

In step S9, if the tension of the web 6 is equal to the preset tension value in the memory 41, the flow advances to preparation for plate removal operation. More specifically, as shown in FIG. 3A, if the potentiometer 24 detects that the tension detection roller 23 maintains the position indicated by a solid line (if the tension of the web 6 is equal to the preset tension value in the memory 41), a predetermined length of web 6 is reeled out to form a slack 6*a* having the same length substantially corresponding to the circumferential length of the plate cylinder 26*a* (step S13). Subsequently, the motor 48 for driving the printing press is stopped (step S14), and the motor 47 for in-feed driving is stopped (step S15), so that plate removal can be started.

In step S13, if the predetermined length of web 6 is not reeled out, the tension of the web 6 and the preset tension value are compared until the predetermined length of web 6 is reeled out.

Figure 4B:
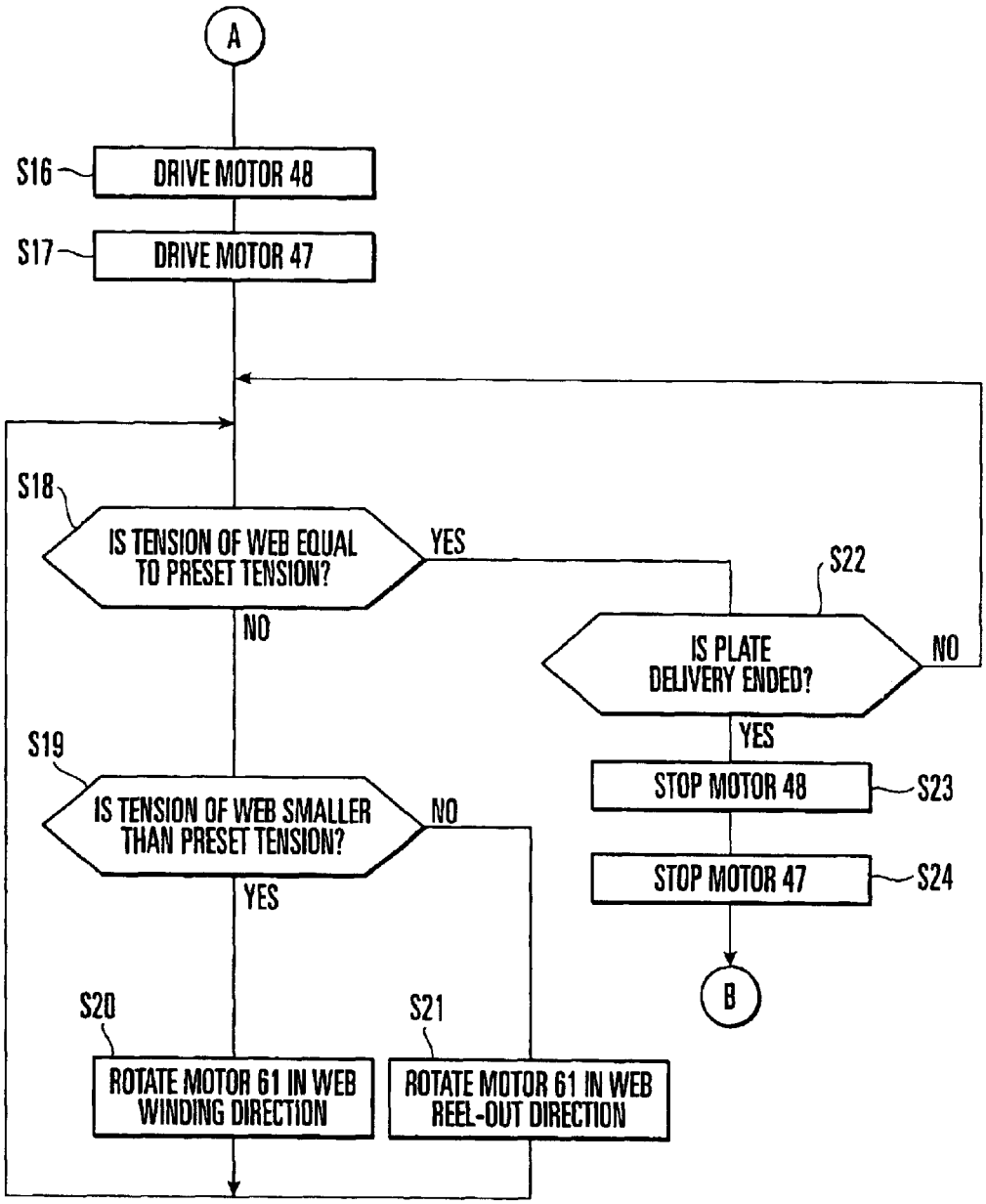
FIG. 4B is a flow chart showing plate removal operation.

Subsequently, as shown in FIG. 4B, the motor 48 for driving the printing press is driven, and the plate cylinders 26*a* and 26*b* are rotated through almost one turn in the reverse direction (step S16). Simultaneously, the motor 47 for in-feed driving is also rotated in the reverse direction (step S17). Accordingly, the web 6 travels in the direction of the arrow B in FIG. 1, and the slack amount of the slack 6*a* decreases. Thus, the dancer roller 30 touching the slack 6*a* moves upward against the biasing force.

Subsequently, the tension of the web 6 at the in-feed unit 3 and the preset tension value are compared in the same manner as in steps S9 and S10 (steps S18 and S19). In FIG. 3A, if the tension detection roller 23 has moved from the position indicated by the solid line to the position 23A indicated by the alternate long and short dashed line (if the tension of the web 6 is smaller than the preset tension value), the control unit 50 controls the motor 61 to rotate in the direction to wind the web 6 (step S20). Hence, even if the web 6 at the in-feed unit 3 slacks, the slack is removed and the web 6 is restored to the taut state.

In FIG. 3A, if the tension detection roller 23 has moved from the position indicated by the solid line to the position 23B indicated by the alternate long and two short dashed line (if the tension of the web 6 is larger than the preset tension value), the control unit 50 controls the motor 61 to rotate in the direction to reel out the web 6. Hence, even if the web 6 at the in-feed unit 3 slacks excessively, the unusual slack is corrected and the web 6 is restored to the state wherein it is stretched taut with a normal tension, so that tearing of the web 6 is prevented.

In step S18, if the tension detection roller 23 maintains the position indicated by the solid line in FIG. 3A (if the tension of the web 6 is equal to the preset tension value), whether plate removal is ended is checked (step S22). If YES, driving of the motor 48 for driving the printing press is stopped (step 23), and driving of the motor 47 for in-feed driving is stopped (step S24). Hence, the plate removal mode is ended, and plate supply can be started.

If plate removal is not ended in step S22, the tension of the web 6 and the preset tension value are repeatedly compared until plate removal is ended.

Figure 4C:
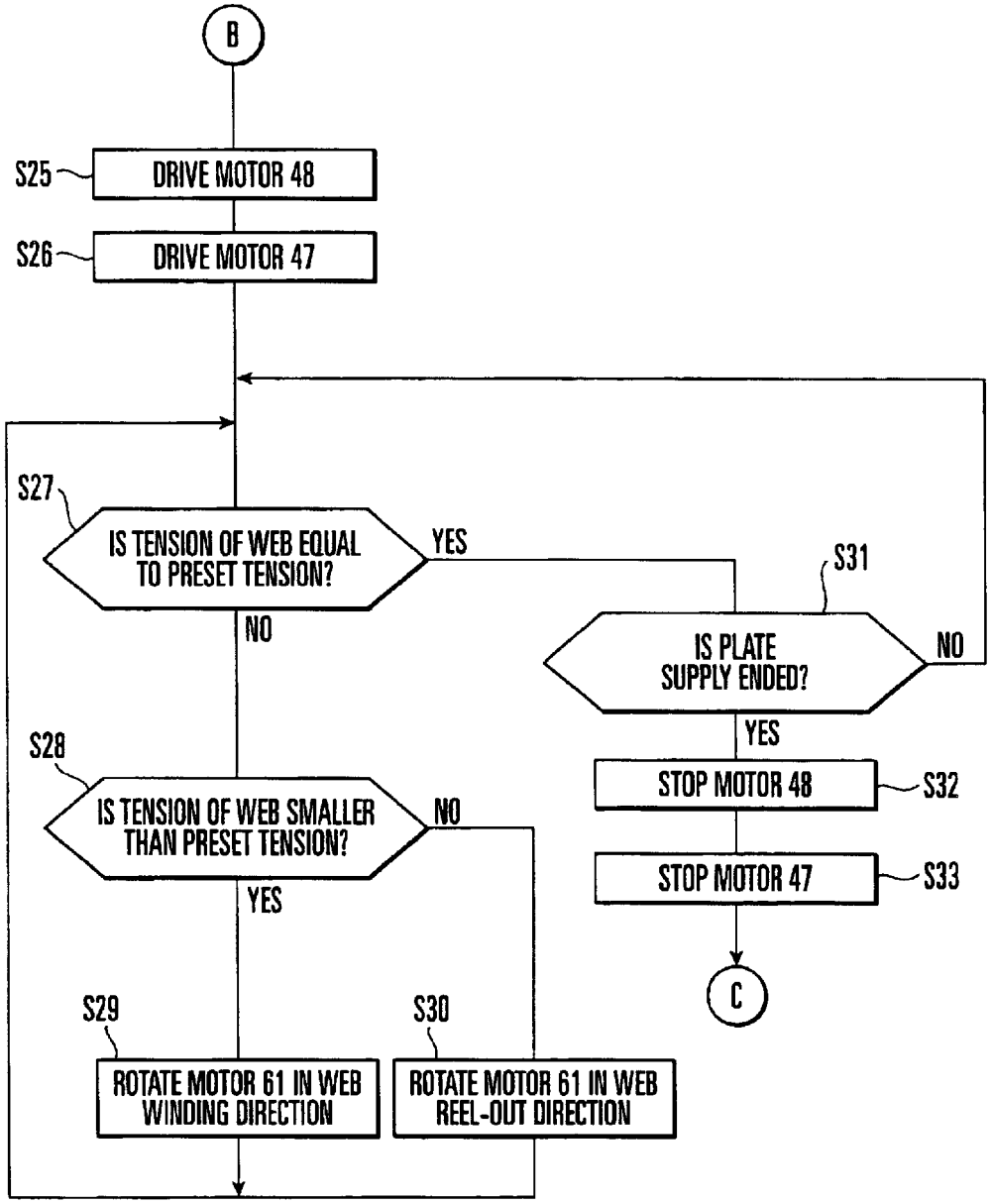
FIG. 4C is a flow chart showing plate supplying operation.

Then, as shown in FIG. 4C, steps S25 to S30 identical to steps S16 to S21 shown in FIG. 4B are performed.

In step S27, if the tension detection roller 23 maintains the position indicated by the solid line in FIG. 3A (if the tension of the web 6 is equal to the preset tension value), whether plate supply is ended is checked (step S31). If YES, driving of the motor 48 for driving the printing press is stopped (step 32), and driving of the motor 47 for in-feed driving is stopped (step S33). Hence, the plate supply mode is ended.

If plate supply is not ended in step S31, the tension of the web 6 and the preset tension value are repeatedly compared until plate supply is ended.

Figure 4D:
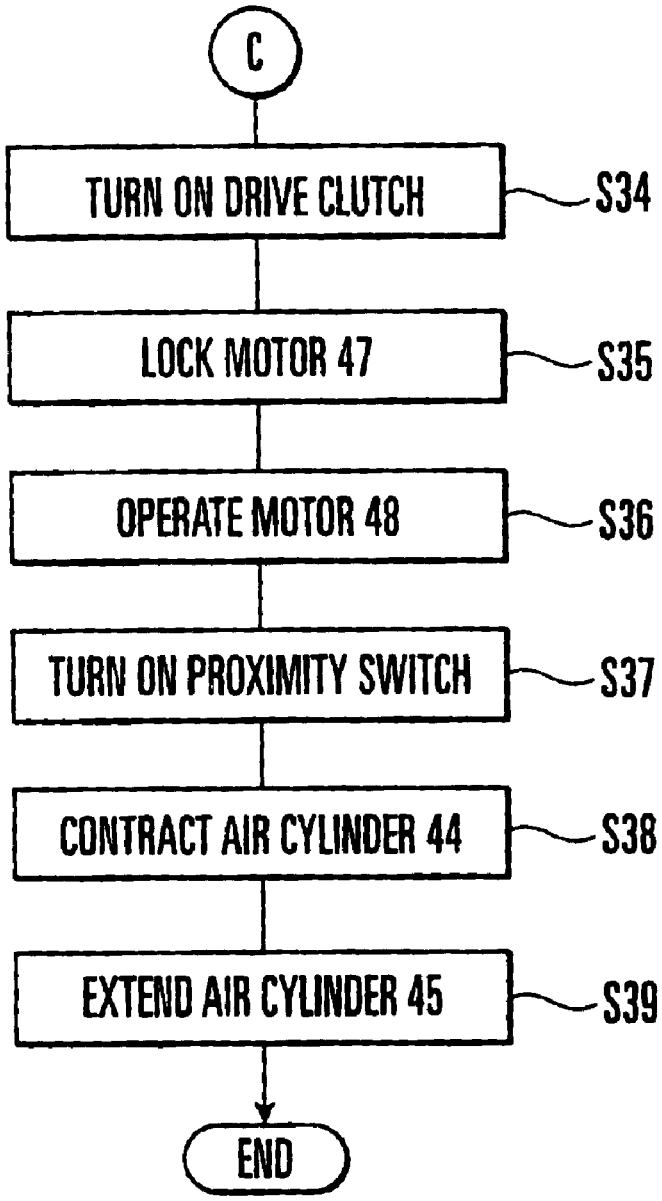
FIG. 4D is a flow chart showing operation after plate mounting.

When plate supply is ended, as shown in FIG. 4D, the drive clutch 46 is turned on (step S34) to connect the driving mechanism of the folding machine 5 and the driving mechanisms of the printing units 4*a* to 4*d* to each other. Then, the motor 47 is locked (step S35), and the in-feed driving roller 19 is braked as it is in contact opposite to the in-feed paper press roller 20. Since the motor 61 (and the winding roll 10) is locked in step S8, feeding of the web 6 from the winding roll 10 is discontinued.

Then, when the motor 48 is driven (step S36), the web 6 is pulled from the folding machine 5 in the direction of the arrow A, so that the dancer roller 30 moves upward. At this time, the dancer roller 30 moves upward smoothly against the downward biasing force, and is restored to the state before plate mounting quickly and smoothly.

In this manner, since the in-feed driving roller 19 and in-feed paper press roller 20 for feeding the web 6 in the in-feed unit 3 can serve as a web press, the structure is simplified and the number of components is reduced. Since the conventionally required web press becomes unnecessary, the entire length of the machine can be shortened. As the web need not be threaded performed through the web press, the web threading operation becomes easily.

Upon the upward movement of the dancer roller 30, when the proximity switch 42 is turned on (step S37), the rod of the air cylinder 44 contracts (step S38), and the dancer roller 30 is positioned at the upper position indicated by the alternate long and two short dashed line in FIG. 1. Then, the rod of the air cylinder 45 extends (step S39), so that the dancer roller 30 is locked at the retreat position above the traveling path of the web 6.

As described above, according to this embodiment, the tension detection unit 22 detects a slack or excessive tension occurring in the web 6 at the in-feed unit 3 during plate mounting operation. In accordance with this detection result, the control unit 50 controls the winding roll 10 to rotate in the direction to wind or reel out the web 6, so that the slack or excessive tension of the web 6 is removed.

According to this embodiment, the in-feed unit 3 requires no dancer roller serving as a wrap-up preventive member. Thus, when performing web threading operation, cumbersome operation of threading the web through the dancer roller or the guide roller provided before or after the dancer roller becomes unnecessary. As the dancer roller is not needed, the entire length of the machine can be shortened accordingly.

As has been described above, according to the present invention, the web threading operation becomes easy, and the entire length of the machine can be shortened. Since the pair of existing rollers in contact opposite to each other can serve as a web press, the structure is simplified, and the number of components is reduced.

What is claimed is:

1. A rotary press comprising;

a printing unit for printing on a web supplied from a winding roll;

a folding machine for folding the printed web supplied from said printing unit;

a wrap-up preventive member retreating from and advancing to a web traveling path between said printing unit and said folding machine, during printing and plate mounting, respectively, to come into contact with the web;

driving means for selectively, rotatably driving said winding roll in a reel-out direction and a winding direction;

tension detecting means for detecting a tension of the web between said winding roll and said printing unit;

control means for controlling said driving means on the basis of a detection result of said tension detecting means during plate mounting;

wherein when said tension detecting means detects a slack, said control means controls said driving means such that said winding roll rotates in the direction to wind the web, and when said tension detecting means detects an excessive tension, said control means controls said driving means such that said winding roll rotates in the direction to reel out the web.

2. A rotary press according to claim 1, further comprising a pair of rollers which are provided between said winding roll and said printing unit and come into contact opposite to each other when feeding the web after plate mounting, to temporarily prohibit web feeding from said winding roll.

3. A rotary press according to claim 2, wherein said pair of rollers comprise a driving roller capable of being rotated and braked selectively and adopted to convey the web from said winding roll to said printing unit, and a paper press roller capable of moving close to and separating from said driving roller, and said driving roller is braked while in contact opposite to said paper press roller.

4. A rotary press according to claim 1, wherein said tension detecting means comprises a detection roller supported movably and caused to touch the web, and position detecting means for detecting a position of said detection roller which moves in accordance with the tension of the web.

5. A rotary press according to claim 4, wherein said position detecting means comprises a lever for supporting said detection roller to be swingable in a direction perpendicular to a web convey direction, and a potentiometer for detecting the tension of the web on the basis of a pivot amount of said lever.

6. A rotary press according to claim 5, wherein said control means rotatably drives said winding roll in the reel-out direction when the tension of the web output from said potentiometer is more than a preset value, and rotatably drives said winding roll in the winding direction when the tension of the web output from said potentiometer is less than the preset value.

7. A rotary press comprising:

a printing unit for printing on a web supplied from a winding roll;

a folding machine for folding the printed web supplied from said printing unit;

a wrap-up preventive member retreating from and advancing to a web traveling path between said printing unit and said folding machine, during printing and plate mounting, respectively, to come into contact with the web;

driving means for selectively, rotatably driving said winding roll in a reel-out direction and a winding direction;

tension detecting means for detecting a tension of the web between said winding roll and said printing unit;

control means for controlling said driving means on the basis of a detection result of said tension detecting means during plate mounting;

wherein when the tension of the web is greater than a preset value said controller controls said drive means such that said winding roller rotates in a reel-out direction and when the tension of the web is smaller than a preset value said winding roller rotates in a winding direction.

8. A rotary press according to claim 7, wherein said tension detecting means comprises a detection roller supported movably and caused to touch the web, and position detecting means for detecting a position of said detection roller which moves in accordance with the tension of the web.

9. A rotary press according to claim 8, wherein said position detecting means comprises a lever for supporting said detection roller to be swingable in a direction perpendicular to a web convey direction, and a potentiometer for detecting the tension of the web on the basis of a pivot amount of said lever.

* * * * *